US006961025B1

(12) United States Patent
Chethik et al.

(10) Patent No.: US 6,961,025 B1
(45) Date of Patent: Nov. 1, 2005

(54) HIGH-GAIN CONFORMAL ARRAY ANTENNA

(75) Inventors: Frank Chethik, Palo Alto, CA (US); Richard Breen, Jr., Fremont, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 85 days.

(21) Appl. No.: 10/643,817

(22) Filed: Aug. 18, 2003

(51) Int. Cl.[7] ..... H01Q 13/00
(52) U.S. Cl. ..... 343/786; 343/705; 343/876
(58) Field of Search ..... 343/705, 757, 343/853, 876, 844, 786

(56) References Cited

U.S. PATENT DOCUMENTS 5,220,330 A * 6/1993 Salvail et al. ..... 342/62
5,347,287 A * 9/1994 Speciale ..... 342/375
5,818,393 A * 10/1998 Fowler et al. ..... 343/705
6,404,404 B1 * 6/2002 Chen et al. ..... 343/844
6,728,554 B1 * 4/2004 Wegner ..... 455/562.1

FOREIGN PATENT DOCUMENTS

US EP 1003241 A1 * 11/1999 ..... H01Q 19/08

* cited by examiner

*Primary Examiner*—Shih-Chao Chen
(74) *Attorney, Agent, or Firm*—McDermott Will & Emery

(57) ABSTRACT

An antenna array system comprising a plurality of antenna elements organized in an array and configured to form a non-planar shaped antenna array surface. The antenna array system further comprises switching circuitry configured to switch each of the plurality of antenna elements on or off based on control signals. In one embodiment, the antenna array system is configured such that the antenna beam direction can be steered in a first direction by switching on a first set of antenna elements, and the antenna beam direction can be steered in a second direction by switching on a second set of antenna elements. In one embodiment, the second set of antenna elements can include one or more antenna elements from the first set of antenna elements, or the second set of antenna elements may not include any antenna elements from the first set.

35 Claims, 11 Drawing Sheets

HIGH-GAIN CONFORMAL ARRAY ANTENNA

BACKGROUND OF THE INVENTION

The present invention relates generally to an antenna array, and more particularly to a high-gain conformal antenna array that can steer its beam direction without the use of phase shifters and beamformer circuitry.

It is often desirable to have antenna arrays that are "steerable," so that the antenna can be used to communicate while the antenna is attached to a moving object. Typically, these "steerable" antennas are phased array antennas. A phased array antenna usually has a non-mechanically steered array of radiators. The radiating elements are passive devices (e.g., dipoles or feed horns), and may include active devices, such as amplifiers. The steering of the beam is carried out by varying the phase (and amplitude for full side lobe control) of the signal in each radiating element. For a passive device, the phase control typically is achieved in a feed assembly placed between a high-power amplifier and the radiating elements, and for an active array, there typically is a phase shifter and amplifier per element per beam.

For a passive array antenna, the high-power amplifier has had the power divided up among a number of different feed lines. Each feed line is acted on by a variable phase-change and a variable attenuator device. The resultant output signal from each feed line then is fed to a passive antenna element. The sum of the many phases and amplitudes generated by the passive antenna element cluster will develop the antenna beam direction and coverage.

For an active array antenna, the phase and amplitudes are controlled by active elements in each feed line. The amplitude is controlled by the gain of an amplifier, and the phase can either be controlled within the amplifier unit itself or by a phase element associated with the radiating device. To steer the beam, many signal lines will each feed an active element, and a complex phase front will be developed by the array. Each beam direction will be determined by the composite phase of the associated phase front for that signal, and each beam shape will be given by the number of individual elements geometry of the array.

The problem with traditional phased array antennas is that they require large, complex and expensive circuitry to make them work. In the passive array case, the antenna array requires a phase shifter and attenuator for each radiating element. Similarly, in the active array case, the antenna array requires an amplifier and phase shifter for each radiating element. As one skilled in the art will appreciate, these phase shifter or beam-forming networks require a significant amount of power, take-up a significant amount of space, and are quite expensive.

Thus, a need arises for a steerable antenna array system that is relatively easy to implement, requires less power-intensive circuitry, and is less expensive than the traditional phased array antennas.

BRIEF SUMMARY OF THE INVENTION

An antenna array system comprising a plurality of antenna elements organized in an array and configured to form a non-planar shaped antenna array surface. The antenna array system further comprises switching circuitry configured to switch each of the plurality of antenna elements on or off based on control signals. In one embodiment, the antenna array system is configured such that the antenna beam direction can be steered in a first direction by switching on a first set of antenna elements, and the antenna beam direction can be steered in a second direction by switching on a second set of antenna elements. In one embodiment, the second set of antenna elements can include one or more antenna elements from the first set of antenna elements, or the second set of antenna elements may not include any antenna elements from the first set.

In one embodiment, the antenna beam direction can be steered in a plurality of directions by switching on a set of antenna elements for each of the plurality of directions. Further, in other embodiments, the antenna array may comprise a transmit antenna array, a receive antenna array, or a combination of a transmit antenna array and a receive antenna array.

In some embodiments, the antenna elements may comprise antenna elements selected from the group consisting of horn antenna elements, dipole antenna elements, patch antenna elements, slot antenna elements, or any other suitable antenna element configuration. In one embodiment, the antenna elements comprise horn antenna elements, such as, for example, cylindrical horn antenna elements, conical horn antenna elements, step-cylinder antenna elements, or any other suitable horn antenna configuration.

In one embodiment, the antenna elements are evenly spaced within the antenna array. In another embodiment, the antenna elements are unevenly spaced within the antenna array. In yet another embodiment, the antenna elements are all the same size.

In accordance with some embodiment of the invention, the non-planar shaped antenna array surface may comprise any non-planar shape, such as a spherical convex shape, a spherical concave shape, a parabolic convex shape, a parabolic concave shape, an ellipsoidal convex shape, an ellipsoidal concave shape, a saddle shape, an air-foil shape, or any other suitable shape that has a region where a plane tangent to that region is perpendicular to a desired direction of radiation.

In one embodiment, the antenna array comprises M-number of antenna elements, and the switching circuitry is configured to connect N-number of the M-number of antenna elements at a given time. In accordance with this embodiment, the switching circuitry comprises a signal splitter adapted to split a signal into N-number of signals. In addition, the switching circuitry includes a switching matrix comprising N×M-number of switches, and switch control circuitry adapted to control the switching matrix so that a specified set of the N-number of M-number of antenna elements are switched on.

In one embodiment, the switching matrix comprises MEMS (micro electro-mechanical systems) switches. In another embodiment, the switching circuit further comprises a signal amplifier adapted to amplify the signal prior to the signal entering the signal splitter. Further, in yet another embodiment, the switching circuitry may include a filter/diplexer adapted to separate transmit and receive signals to/from the antenna array.

In yet other embodiments, antenna array comprises a hexagonal array of antenna elements. The hexagonal array may comprise a plurality of hexagonal antenna element clusters abutted together to form the hexagonal array. In accordance with this embodiment, each hexagonal antenna element cluster comprises X-number of antenna elements configured in a hexagonal arrangement.

In another embodiment, the antenna array comprises N-number of the hexagonal antenna element clusters, and the switching circuitry is configured to control X-number of antenna elements at a given time. In accordance with this embodiment, the switching circuit comprises a signal splitter adapted to split a signal into X-number of signals, a switching matrix comprising X-number of 1×N switches, and switch control circuitry adapted to control the switching matrix so that a contiguous set of the X-number of the antenna elements are enabled. In some embodiments, the 1×N switches comprise multiplexers. In other embodiment, the antenna array comprises a total of M-number of antenna elements, and the 1×N switches comprise M-number of on/off switches.

In accordance with some embodiments of the invention, the antenna array system can be used in any environment in which antenna are used, including but not limited to, satellite ground stations, air-borne vehicles, space vehicles, water vehicles, and ground vehicles.

The present invention further comprises a spacecraft including the antenna array systems, and the present invention comprises methods for operating antenna array systems set forth herein.

A more complete understanding of the present invention may be derived by referring to the detailed description of preferred embodiments and claims when considered in connection with the figures.

BRIEF DESCRIPTION OF THE DRAWINGS

In the Figures, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION OF THE INVENTION

The present invention relates generally to an antenna array, and more particularly to a high-gain conformal antenna array that can steer its beam direction without the use of phase shifters and beamformer circuitry. Instead, the beam is steered by selecting an array element that points most nearly in the general direction that is desired. One or more arrays of elements that are contiguous to the selected element are enabled. Further, in one embodiment, non-contiguous elements may be selected to help the antenna gain. This ensemble of elements creates a high-gain directional beam in the direction of that beam of the center element.

One environment in which it is favorable to use "steerable" antenna arrays is satellite communications, and in particular with low earth orbit (LEO) and medium earth orbit (MEO) satellites. As one skilled in the art will appreciate, LEO satellites, such as those launched by NASA and other entities, are used for a variety of purposes. For example, such LEO satellites can be used to analyze certain properties or qualities of the earth and objects on the earth, such as magnetic properties of the earth, cloud cover, crop quality, infrared energy from earth objects, and even ground images. The satellites typically include sensors and/or cameras to collect data as they orbit the earth, and they download the data to a terrestrial network gateway as they pass over.

As the satellites collect data, they store it on disks or other media. Then, as the satellites pass into communication "sight" of the terrestrial network gateway, they download as much of the data as possible during the visibility interval. As one skilled in the art will appreciate, this interval can be as low as about 3–4 minutes and as high as about 20 minutes.

As one skilled in the art will appreciate, there are a number of factors that affect the transmission of data from low earth orbit (LEO) and medium earth orbit (MEO) satellites to terrestrial receiving stations, such as weather and the location of the satellite in relation to the receiving station.

Figure 1:
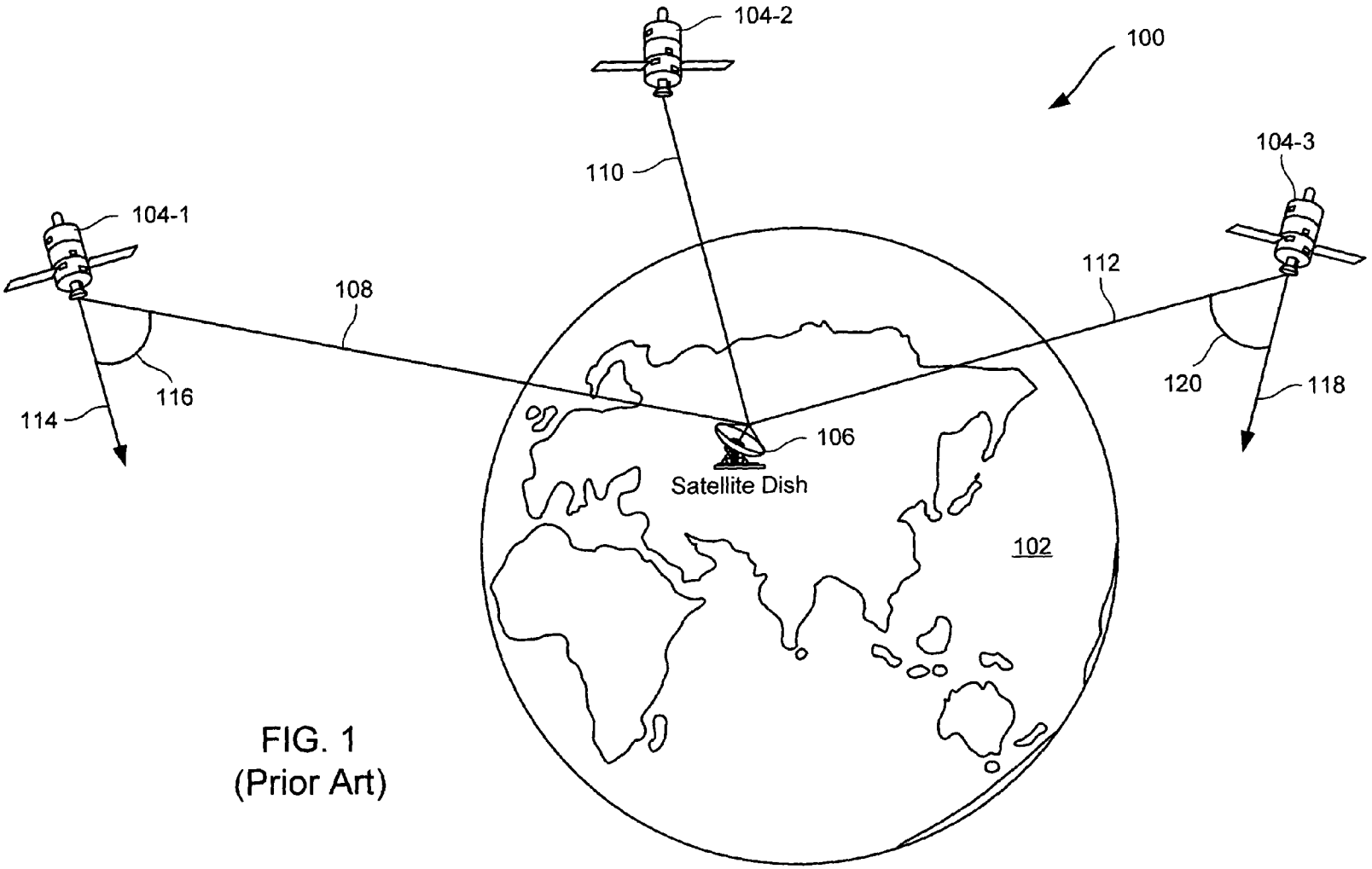
FIG. 1 (Prior Art)
FIG. 1 is a drawing showing angles of communication for prior art low earth orbit satellites.

For example, as illustrated in FIG. 1, when a satellite 104 first comes into view of a terrestrial receiving station 106 (e.g., on earth 102), it still is a relatively long distance from the station (see path length 108). As a result, the path loss through free space and long atmospheric path creates signal losses, which limit the rate of data that can be transmitted from the satellite to the terrestrial receiving station. As time passes, satellite 104 passes more overhead of terrestrial receiving station 106, shortening the free space distance between satellite 104 and station 106 and shortening the path through the atmosphere (see path length 110), and thus increasing the data rate transmission capacity. Late in the pass the path length increases (see path length 112), thus decreasing the data transmission capacity again.

Because there is greater path loss the further the satellite is from the terrestrial receiving station, it would be desirable to have satellite antennas with higher gains at the further distances. Unfortunately, however, in most cases the opposite is true. As one skilled in the art will appreciate, as a satellite rises above the horizon and come into "view" of the terrestrial receiving station, the antenna is not pointing at the receiving station, but rather, at some point just past the horizon.

This is illustrated in FIG. 1, which shows an antenna pointing path 114 as satellite 104 rises into view of the terrestrial receiving station. As one can see, the antenna pointing path 114 is an angle 116 away from the direct pointing path to terrestrial receiving station 106. Similarly, as the satellite sets, the same problem exists. That is, the antenna pointing path 118 is an angle 120 away from the direct pointing path to the terrestrial receiving station. Only when satellite 104 is directly overhead of terrestrial receiving station 106 does the antenna point directly at the receiving station.

Figure 2:
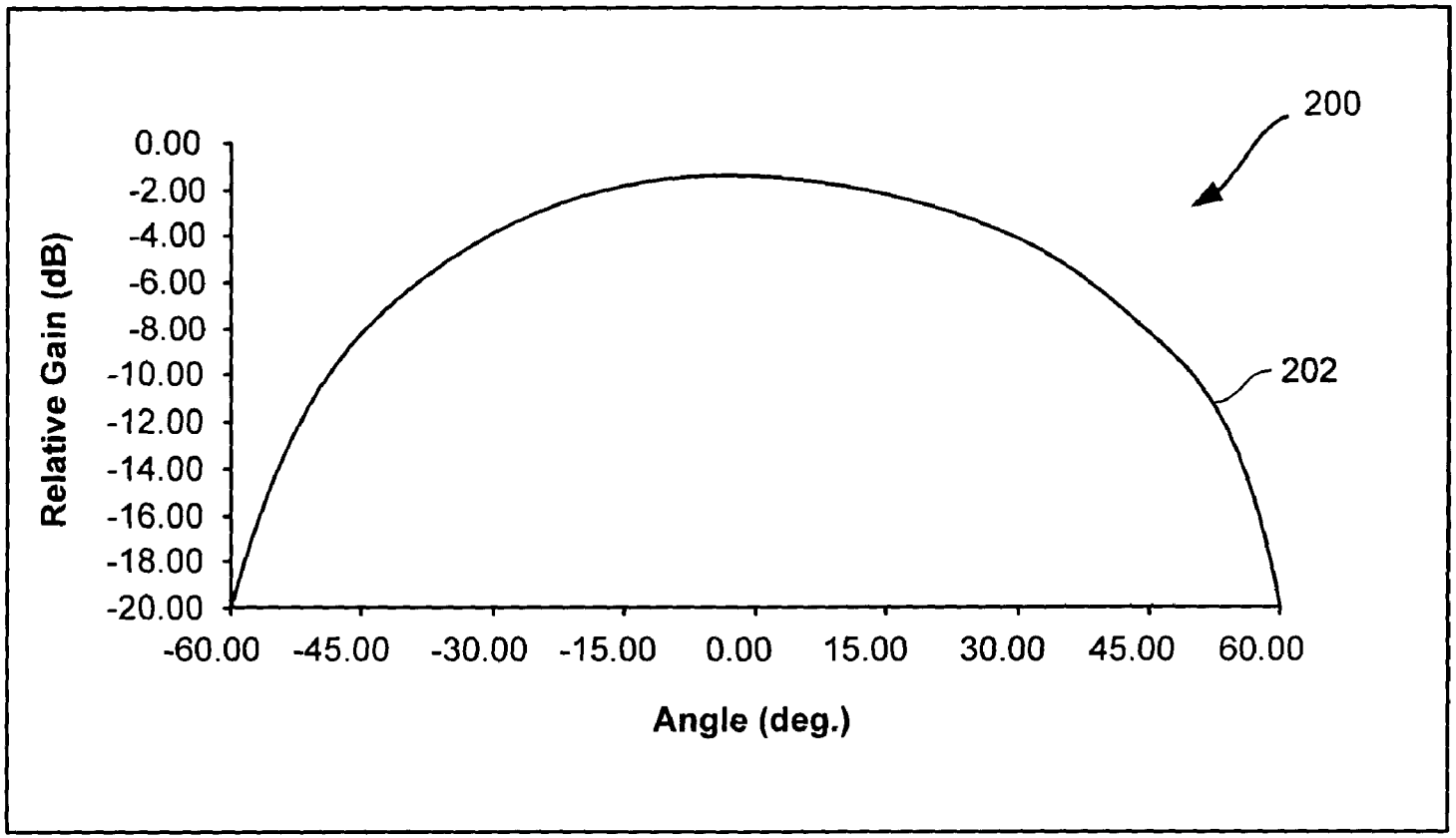
FIG. 2 (Prior Art)
FIG. 2 is a graph showing gain characteristics for prior art low earth orbit satellites.

Because the antenna generally is not pointing at the receiving station as it traverses its orbit path, the antenna gain actually is worse at these greater distances, rather than better, which is the desired result. This is illustrated in the graph 200 of FIG. 2, which shows a gain curve 202 for a typical LEO satellite as it traverses through an orbit. As one can see, the gain is highest when the satellite is over the receiving station (angle 0.00) and then decreases as the satellite is further from the overhead position, with the antenna having very poor gain characteristics at angles over 45 degrees. These gain characteristics are typical for most LEO satellites, even when the satellites are equipped with bulky, expensive and complex beam-forming antenna systems.

Figure 3:
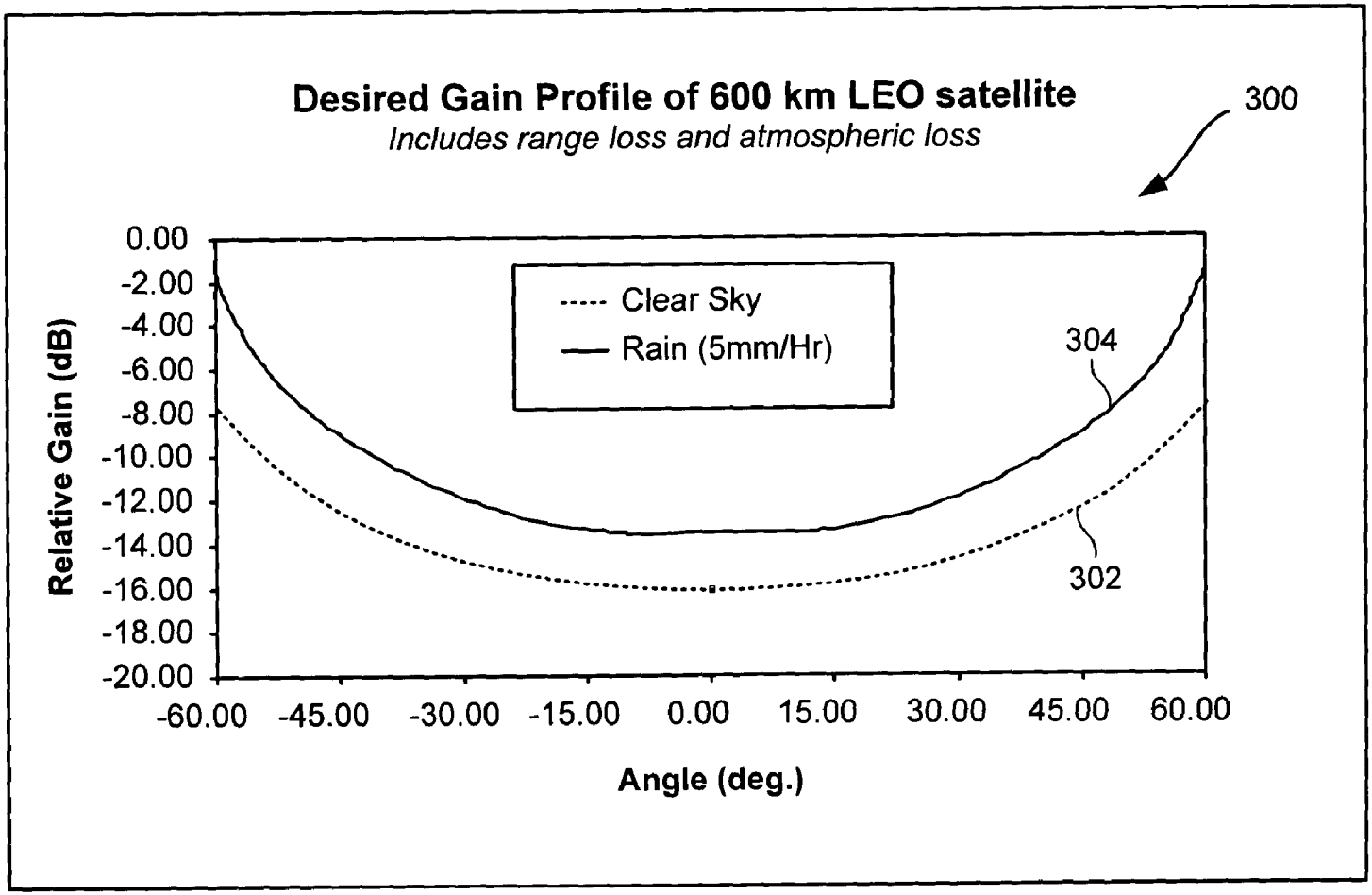
FIG. 3 is a graph showing a desired gain characteristic for low earth orbit satellites that can compensate for path loss variation with respect to the satellite's nadir pointing angle.

FIG. 3 illustrates a graph 300 showing more preferred gain characteristics for a LEO statellite antenna system. Graph 300 shows examples of two preferred gain curves 302 and 304. Gain curve 302 is an example gain curve for clear skies and gain curve 304 is an example gain curve for one rain scenario. As one can see, when it is raining or other inclement weather exists, it is desirable to have an antenna with higher gain to offset the losses caused by the weather. While the gain curves in FIG. 3 are preferred, one skilled in the art will appreciate that any gain characteristic that is better than that illustrated in FIG. 2 would be an improvement. The present invention, thus, provides an antenna configuration and system with improved gain characteristics for more optimum radiation characteristics for LEO and MEO satellites.

While satellites are one environment in which the antenna array system of the present invention can be used, one skilled in the art will appreciate that it is not limited to this environment. The antenna array system of the present invention can be used in any environment in which it is desirable to have a "steerable" antenna beam or multiple antenna beams. For example, the antenna array system of the present invention can be used with steerable satellites, steerable satellite ground stations, air vehicles, water vehicles, and ground vehicles. Air vehicles may include, but are not limited to, airplanes, helicopters, balloons, missiles, and endo- and exo-atmospheric platforms. Similarly, water vehicles can include boats and submarines, and ground vehicles can include any form of ground vehicle, such as cars, trucks, tanks, fighting vehicles or the like.

As previously stated, the present invention relates to a high-gain conformal or shaped antenna array that can steer its beam direction without the use of phase shifters and beamformer circuitry. Because the antenna array may be formed or shaped, the beam from the antenna array can be steered by enabling a set of antenna elements that will create a desired directional gain characteristic. To steer the antenna beam in a different direction, a different set of antenna elements can be enabled. By selecting different sets of antenna elements on the antenna array, any number of different beam steering directions can be selected without the need for very expensive, power intensive phase shifters, transmitters, and radiator elements, and the associated circuitry.

Figure 4A:
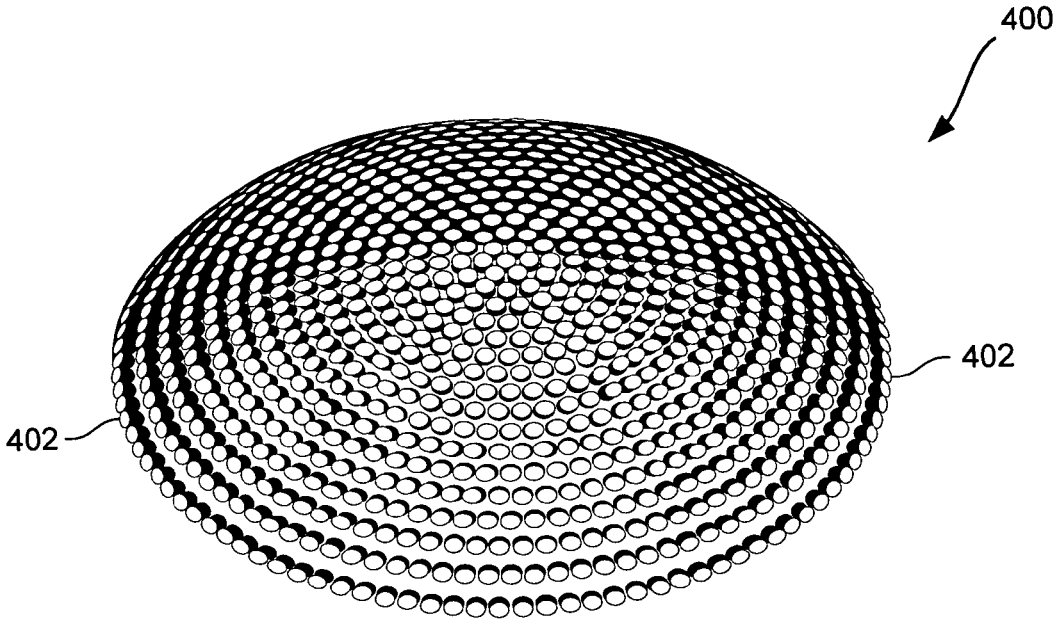
FIG. 4*a* is a drawing of a conformal antenna array in accordance with one embodiment of the present invention.
Figure 4B:
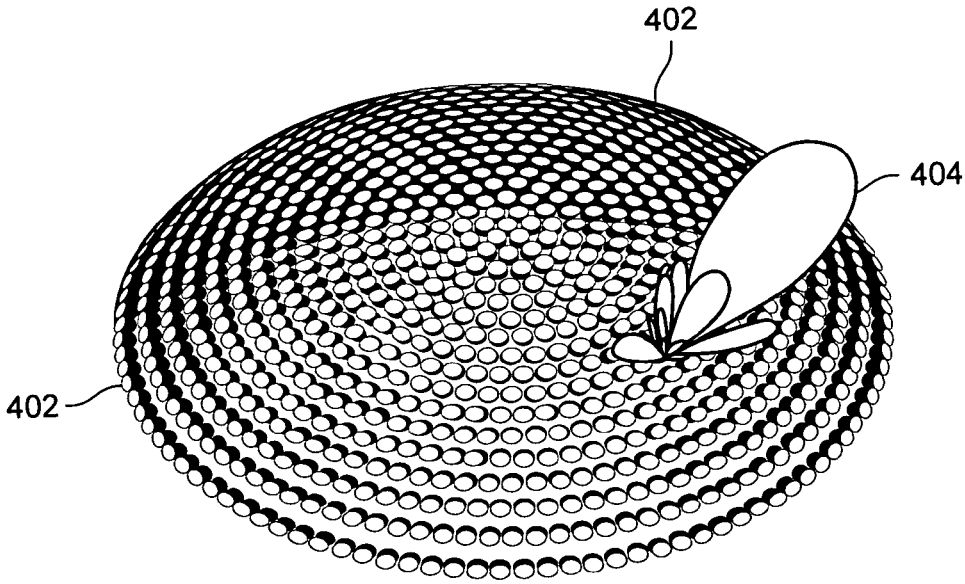
FIG. 4*b* is a drawing of the antenna array of FIG. 4 illustrating gain characteristics of one of the antenna elements of the array.

Referring now to FIGS. 4*a* and 4*b*, one embodiment of a conformal antenna array 400 of the present invention is shown. Antenna array 400 comprises a plurality of antenna elements 402 organized in an array and configured to form a non-planar shaped antenna array surface. Antenna elements 402 can comprise any suitable antenna element, such as a horn antenna element, a patch antenna element, a dipole antenna element, a helical antenna element, a slot antenna element, or any other suitable antenna element configuration. In one embodiment of the invention, antenna elements 402 comprise horn antenna elements, such as cylindrical horn antenna elements, conical horn antenna elements, or step-cylinder horn antenna elements. In other embodiments, rectangular or pyramidal horn antenna elements can be used.

Antenna elements 402 may be symmetrically located within antenna array 402 or they may have a non-symmetrical configuration. Further, antenna elements 402 may be evenly or unevenly spaced within the array, and the antenna elements all may be the same size, or the array may include a plurality of different sized antenna elements. Also, the shape of the conformal array is non-planar and may comprise any suitable shape configuration, such as a spherical convex shape, a spherical concave shape, a parabolic convex shape, a parabolic concave shape, an ellipsoidal convex shape, an ellipsoidal concave shape, a saddle shape, an air-foil shape, or any other shape that has a region where a plane tangent to that region is perpendicular to a desired direction of radiation.

As illustrated in FIGS. 4*a* and 4*b*, one embodiment of the invention may comprise a convex spherical shaped array 400, having symmetrically oriented and evenly spaced antenna elements 402. In the illustrated embodiment, the antenna elements 402 are organized in a hexagonal configuration, and all the antenna elements are the same size. FIG. 4*b* illustrates gain characteristics 404 for one of antenna elements 402 in the illustrated embodiment of antenna array 400. As illustrated, because the antenna array is shaped, the antenna beam may be pointed at a directional angle not necessarily perpendicular to the center of the array.

Figure 5:
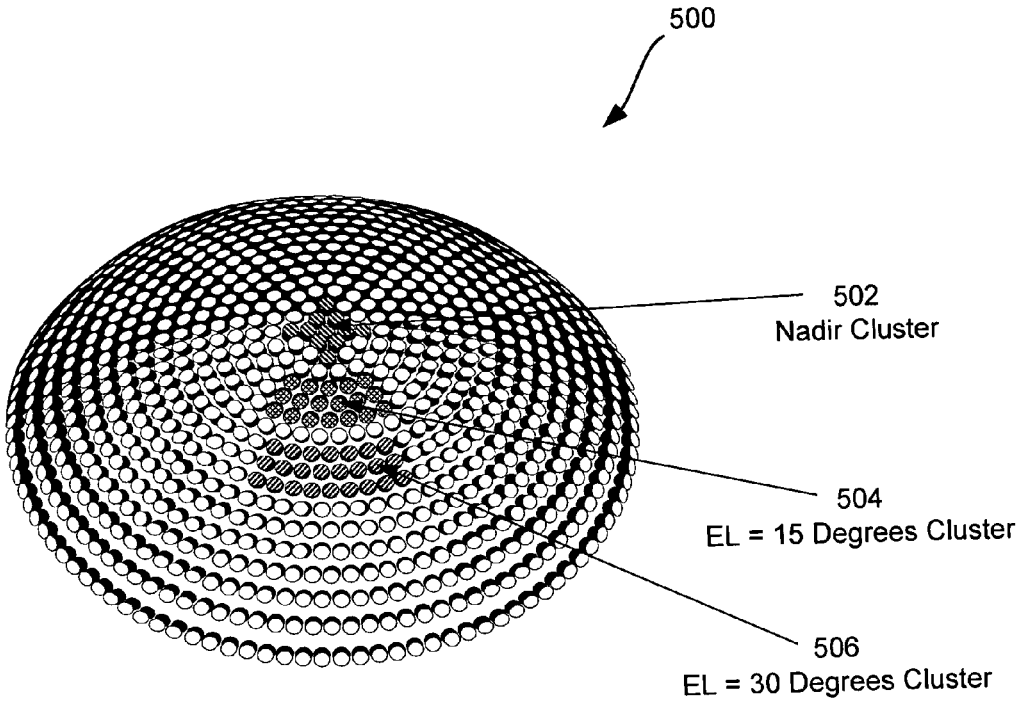
FIG. 5 is a drawing of the antenna array of FIGS. 4*a* and 4*b* showing different clusters of active antenna elements.

Referring now to FIG. 5, a conformal array 500 is shown. In this embodiment, a cluster of feeds 502 termed the nadir cluster points at a nadir located communications target. A cluster 504 centered on a horn that is 15° displaced from nadir points at a communications target that is 15° from the nadir axis. Similarly, a cluster 506 centered on a horn that is 30° displaced from nadir points at a communications target that is 30° from the nadir axis, and so on.

Figure 6A:
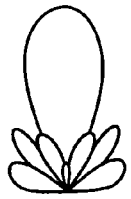
FIG. 6*a* is a drawing showing gain characteristics of one of the clusters of active antenna elements of FIG. 5.
Figure 6B:
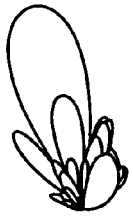
FIG. 6*b* is a drawing showing gain characteristics of a second of the clusters of active antenna elements of FIG. 5.
Figure 6C:
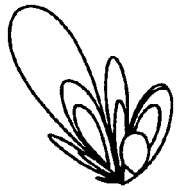
FIG. 6*c* is a drawing showing gain characteristics of a third of the clusters of active antenna elements of FIG. 5.

FIGS. 6*a*, 6*b* and 6*c* illustrate the gain characteristics for clusters 502, 504 and 506 respectively. All of these beam characteristics are very similar, differing only in minor detail and pointing direction. Thus, the beam angle of the antenna can be moved or steered merely by switching on/off different antenna elements on the array. In this manner, the beam of the illustrated antenna array can cover virtually any forward pointing direction by controlling the switching of the power to clusters of the individual antenna elements.

Figure 7:
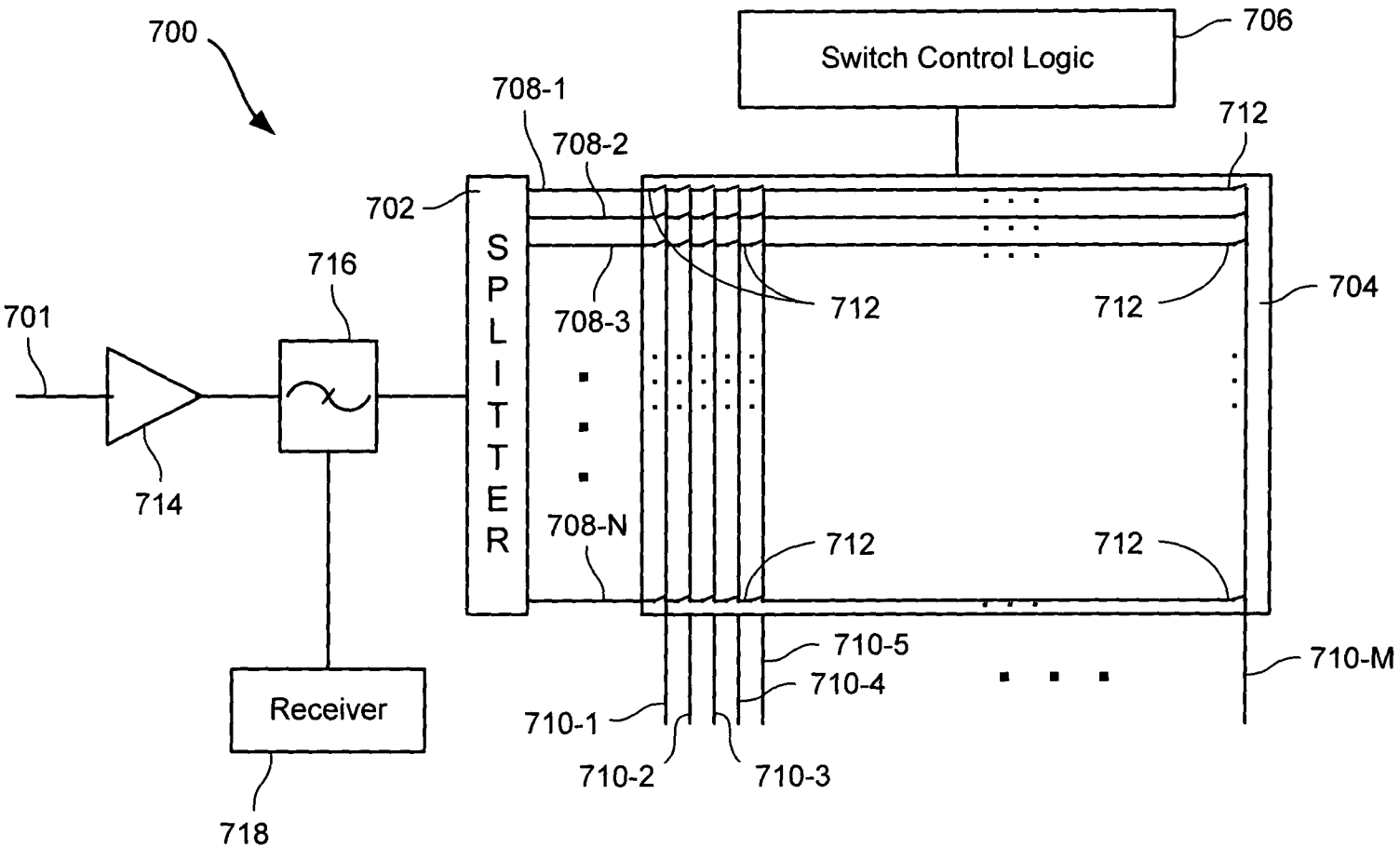
FIG. 7 is a schematic drawing of an antenna array switching circuitry in accordance with one embodiment of the present invention.

As discussed, beam steering for the conformal antenna arrays of the present invention is controlled by switching on/off antenna elements or sets of antenna elements on the shaped surface of the antenna array, not by the use of phase shifters. Referring now to FIG. 7, one embodiment of an exemplary switching circuitry 700 for the present invention is shown. Circuitry 700 comprises an input signal source 701, a power splitter 702, a switching matrix circuitry 704, and a switch control logic processor 706. In accordance with this exemplary embodiment of the invention, it will be assumed that an antenna array comprises M-number of antenna elements, and it is desirable to steer the antenna beam by turning on different subsets of the M-number of antenna elements. In accordance with this example, the subset(s) of antenna elements may comprise N-number of antenna elements.

Because it is desirable to enable N-number of antenna elements at any one given time, the antenna will need N-number of signals to drive the antenna elements. Thus, power splitter 702 is configured to divide signal 701 into N-number of signals 708-1-708-N, which in turn enter switching matrix 704. Switching matrix 704 comprises one input for each antenna element that can be powered on at one time (N), one output for each antenna element in the antenna array (M), and one switch 712 for each combination of input signal and output (N×M). In this manner, any subset combination of N-number of antenna elements of the total M-number of antenna elements can be powered-on at a time. Thus, for example, if an antenna array comprises 2000 individual antenna elements, and the system is configured so that a subset of 200 antenna elements can be powered on at any one time, switching matrix 704 will include 400,000 switches (200×2000). The antenna elements that are enabled need not be contiguous, so different groups or rings of antenna elements can be enabled at any given time to support multiple beams or to meet the phase constraints as discussed below.

Switches 712 within switching matrix 704 may comprise any suitable switch type, such as MEMS switches, pin-diode switches, or the like. Because of the large number of switches that may be required, in one embodiment, it may be preferable to use MEMS switches to control the size of the array.

Switch control logic 706 is configured to control the switching matrix 704, and in particular, individual switches 712. Switch control logic 706 may comprise any suitable control circuitry, such as an embedded mirco-processor, an FPGA, an ASIC, or the like, and it may receive switch control signals other sources, such as a master processor or the like. The details of control circuitry 706 should be apparent to those skilled in the art, and thus, will not be discussed in detail herein.

In other embodiments of the invention, switching circuitry 700 may comprise a signal amplifier 714, which amplifies the input signal 701 before it passes into splitter 702. In addition, for antennas arrays configured for both transmit and receive, switching circuitry 700 may include a filter/diplexer 716 which separates the transmit signals from the receive signals. In the illustrated embodiment, the transmit signals pass into splitter 702, while the receive signals are passed to a receiver 718.

Figure 8A:
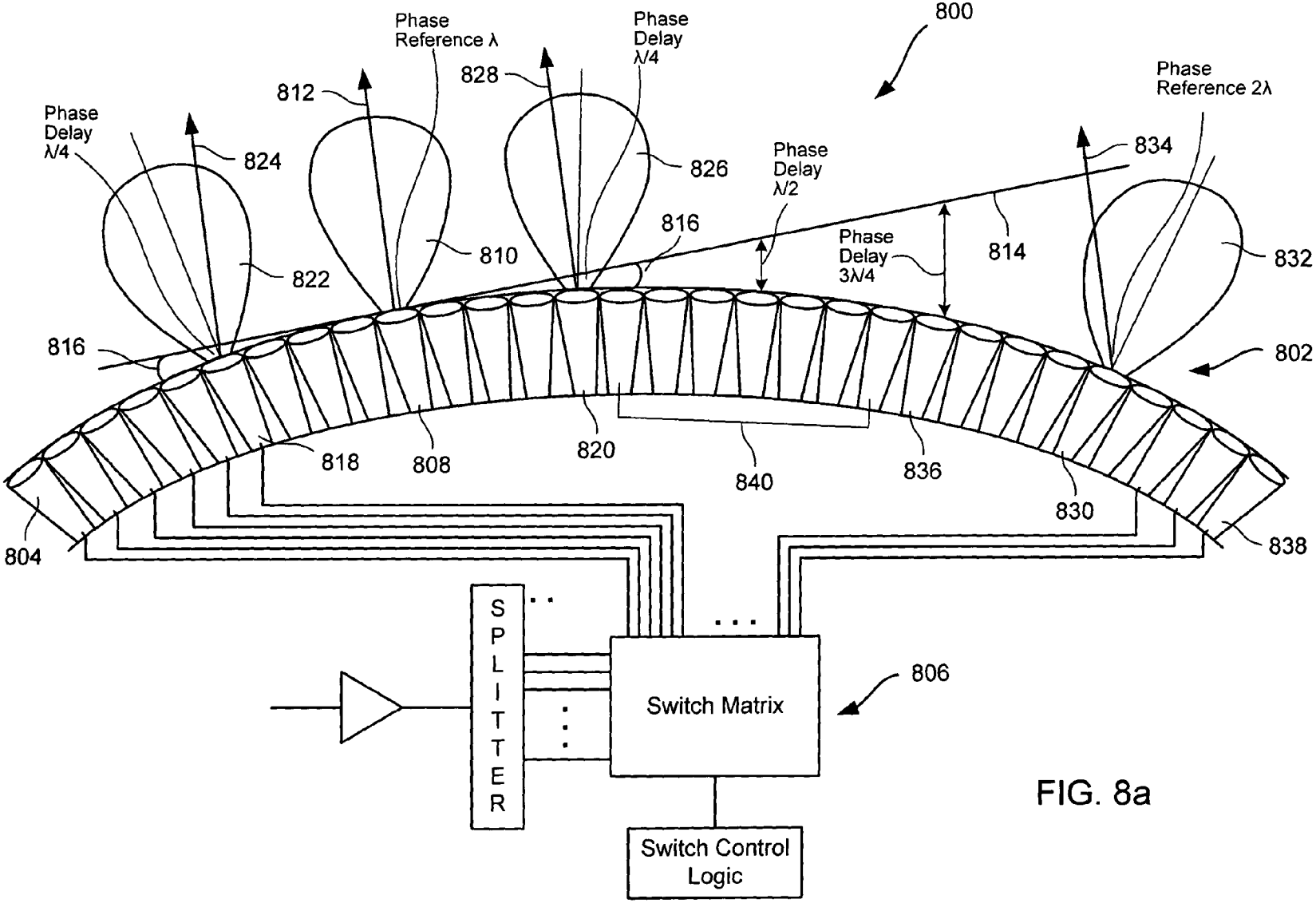
FIG. 8*a* is a cross-sectional view of one embodiment of a conformal array of the present invention showing gain characteristics from some of the antennal elements of the array.

Referring now to FIG. 8*a*, the operation of one embodiment of a conformal array 800 in accordance with the present invention will be described. In the illustrated embodiment, array 800 comprises a shaped surface 802, a plurality of antenna elements 804, and switching circuitry 806. As discussed above shaped surface 802 may comprise any number of different shaped surfaces, and antenna elements 804 may comprise any antenna element type, such as horn antenna elements, or the like. Further, switching circuitry may comprise the switching circuitry illustrated in FIG. 7 and disclosed above, or the switching circuitry may comprise other embodiment. In the illustrated embodiment, the shaped surface comprises a convex spherical surface and the antenna elements comprise horn elements.

To point a beam in a particular direction with maximum gain or a desired gain, it may be preferable to enable as many antenna elements as possible, or at least a pre-selected number of antenna elements. One issue with using a shaped array, however, is that the shape will cause phase differences between the elements. For example, as illustrated in FIG. 8*a*, assume the desired direction of the antenna beam is along arrow 812. In this case, antenna element 808 (the "reference antenna element") will produce a gain pattern or radiation pattern 810 which has a main lobe axis in the desired beam direction 812. Other antenna elements also will have radiation patterns, which can contribute to the beam gain in the desired direction, but because of the shape of the array, phase differences caused by the contour of the antenna surface will limit the cluster size that may produce a useful antenna beam shape.

The phase differences are caused by the location of the antenna elements with respect to reference antenna element 808 which has the radiation pattern in the desired direction. For example, reference antenna element 808 points its beam 812 perpendicular to its aperture. Because of the shape of the array, other antenna elements do not point in the same direction, and in addition, their signal phases are not aligned with the signal from element 808. In most instances, the phase shift is greater for elements further away from reference element 808 and is a function of the angle 816 between plane 814 and the surface of the array 802. Because of the phase shift, there is a loss of coherence between the signal from element 808 and all other elements in its cluster and on the antenna array.

As one skilled in the art will appreciate, phase delayed signals will have components that can add to the overall signal, but at a certain point, will also subtract or cancel from the signal. This limits the size of the cluster, and hence, the maximum gain of a cluster array That is, if reference element 808 has a reference phase $\lambda$, elements having a phase delay such that the phase reference is $\lambda/2$ will cancel the signal. Thus, in one embodiment, only antenna elements having phase delays within multiples of about $\pm\lambda/4$ may operate effectively. For example, both elements 818 and 820 have phase delays of $\lambda/4$ and thus can be used. As illustrated, element 818 has a radiation pattern 822, which includes a contributing gain component 824 in the desired beam direction 812, and element 820 has a radiation pattern 826, which also includes a contributing gain component 828 in the desired beam direction 812. In this example, all elements between elements 818 and 820 also could be used, because they also will have phase delay offsets to the plane perpendicular to the beam pointing direction within $\pm\lambda/4$.

Figure 8B:
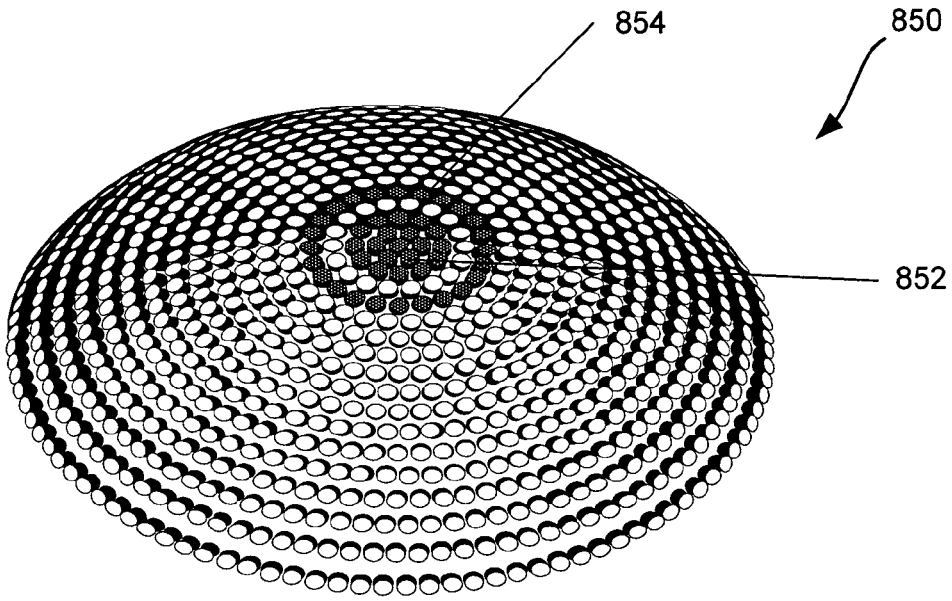
FIG. 8*b* is a is a drawing of a conformal antenna array in accordance with one embodiment of the present invention which uses non-contiguous rows of elements are used for a nadir-pointing beam.

In addition, elements that have phase delays that are integer multiples of $\lambda$ also can be used. For example, element 830 has a phase delay of $2\lambda$, and includes contributing gain component 834 from its radiation pattern 832. In addition, elements 836 and 838 are within multiples of $\pm\lambda/4$, so those elements as well as the elements between them can also be use. In the illustrated embodiment, the group of elements 840 probably should not be used because they will have more of a canceling effect, and thus will reduce the gain of the antenna. Also, as shown in FIG. 4, the further the elements are from the reference element 808, the less the elements contribute to the overall gain of the antenna. Therefore, there is a practical limit as to which elements can be used. However, FIG. 8*a* does illustrate that it is possible, and perhaps preferable, to use non-contiguous elements to generate the beam. FIG. 8*b* further illustrates an embodiment of an antenna array 850 in which non-contiguous rows of elements 852, 854 may be used for a nadir-pointing beam.

Figure 9A:
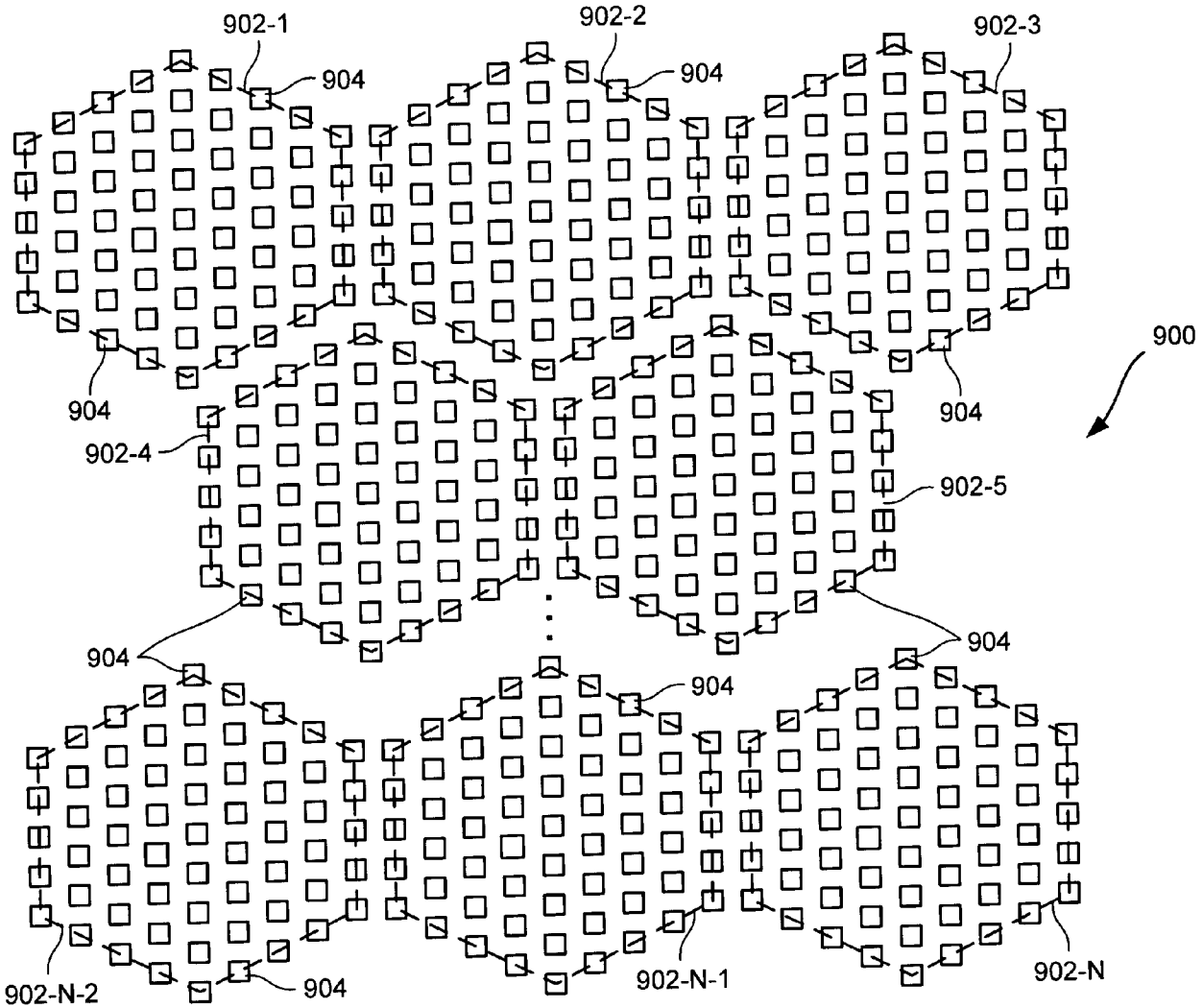
FIG. 9*a* is a schematic drawing of one embodiment of an antenna array of the present invention having antenna elements arranged in a hexagonal configuration.
Figure 9B:
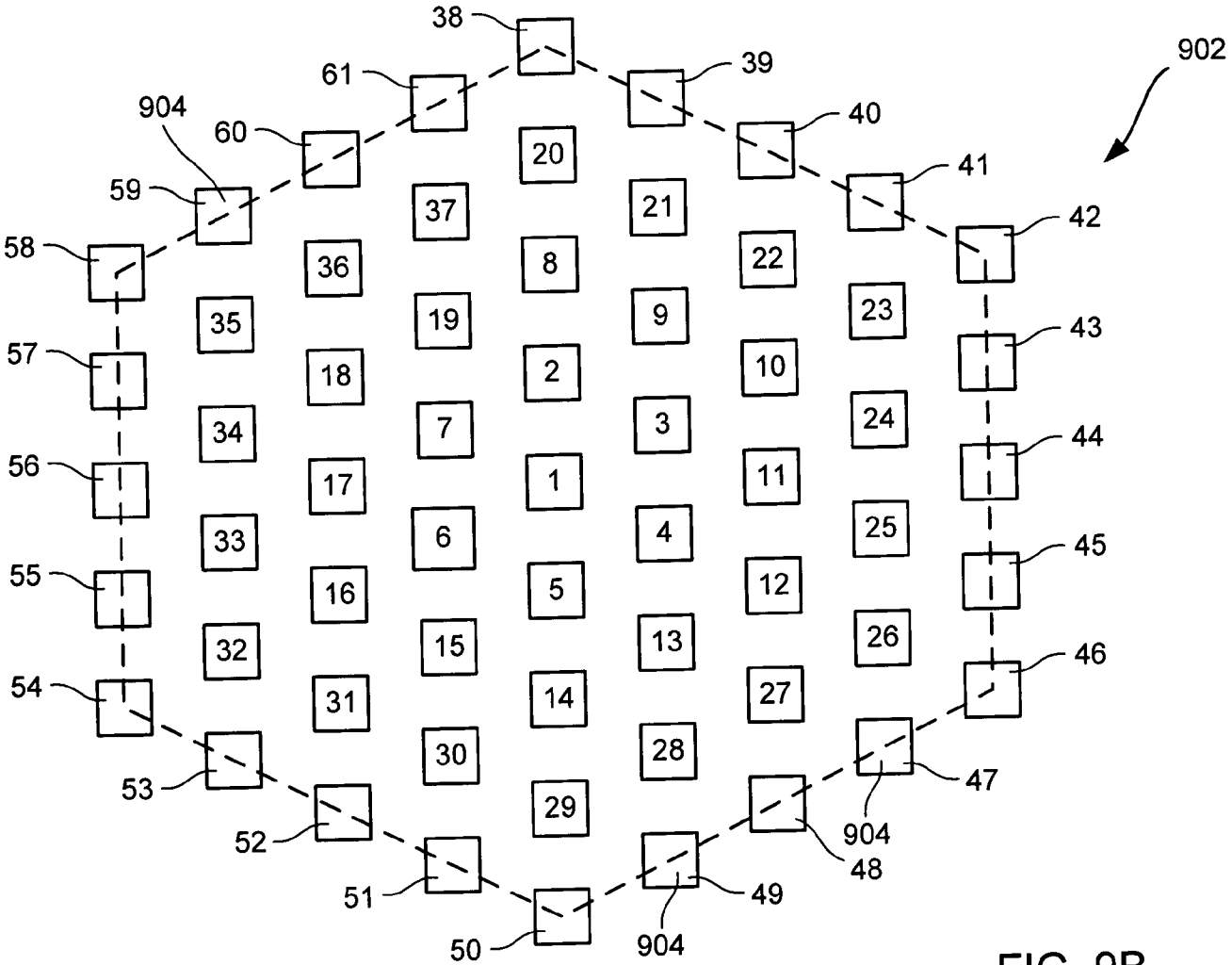
FIG. 9*b* is a schematic drawing of one hexagonal cluster of the antenna array of FIG. 9*a*.

Referring now to FIGS. 9*a* and 9*b*, another embodiment of an antenna array configuration 900 in accordance with the present invention is shown. The illustrated embodiment shows the array configuration as a planar array for illustrative purposes. As with the embodiment discussed above, the shape of the array surface can be any suitable shape, such as a convex spherical array, a concave spherical array, a convex parabolic array, a concave parabolic array, a convex ellipsoidal array, a concave ellipsoidal array, a saddle shaped array, an air-foil shaped array, or any other suitable shape as previously discussed. In addition, the actual shape of the array may be of the form of a uniform periodic array warped to a hemispherical shape.

In the embodiment illustrated in FIG. 9*a*, array 900 comprises a plurality of hexagonal array clusters 902-1 to 902-N abutted to form the array pattern. Each hexagonal array cluster 902 comprises a plurality of antenna elements 904, which may be any suitable antenna element as discussed above. In one embodiment of the invention, as illustrated in FIG. 9*b*, each hexagonal array cluster 902 comprises 61 antenna elements. In this configuration, there is a center element (1), a first ring of 6 elements (2–7) forming first a hexagon, a second ring of 12 elements (8–19) forming a second hexagon, a third ring of 18 elements (20–37) forming a third hexagon, and a forth ring of 24 elements (38–61) forming a forth hexagon. In one embodiment, the elements are the same size and equally spaced within the array, although this is not required and other embodiments may be configured differently.

In this particular embodiment, antenna array 900 will have 61 or fewer antenna elements active at any one time. The active or enabled antenna elements may coincide with one of the hexagonal array clusters 902, or the active or powered-on antenna elements may overlap multiple hexagonal array clusters 902. In any event, with this particular configuration, the switching circuitry needed to drive the antenna array will only require one switch per antenna element in the array, not the N×M-number of switches as disclosed in the matrix switch embodiment above.

Figure 10:
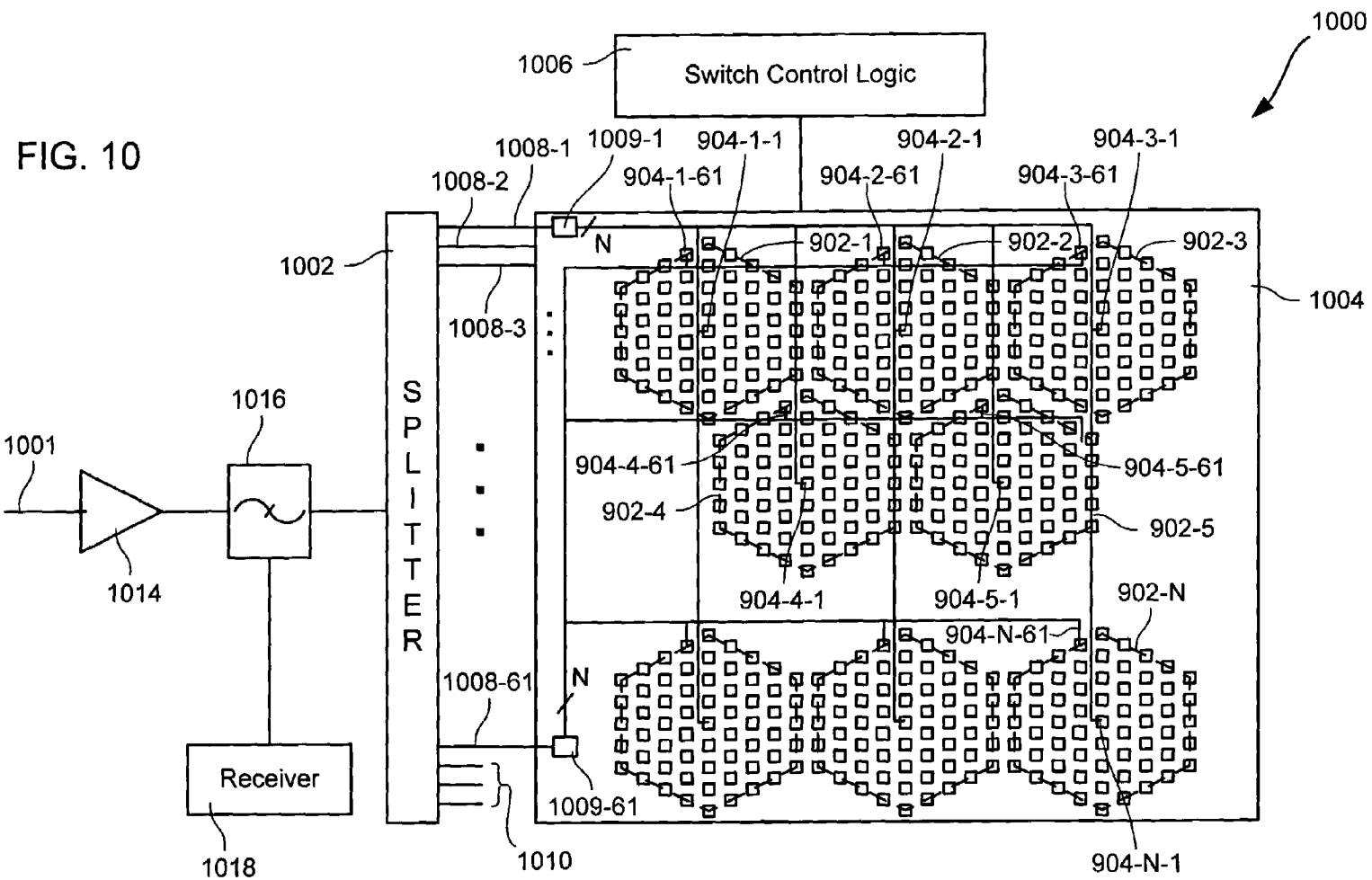
FIG. 10 is a schematic drawing of one embodiment of an antenna array switching circuitry for the antenna array illustrated in FIG. 9*a*.

Referring now to FIG. 10, one embodiment of an exemplary switching circuitry 1000 for the antenna array embodiment illustrated in FIGS. 9*a* and 9*b* is shown. Circuitry 1000 comprises an input signal source 1001, a power splitter 1002, switching circuitry 1004, and a switch control logic processor 1006. In accordance with this exemplary embodiment of the invention, it will be assumed that the antenna array 900 comprises N-number of hexagonal array clusters 902 with each comprising 61 antenna elements 904, as illustrated in FIGS. 9*a* and 9*b*. In accordance with this embodiment, switching circuitry is configured to switch on a set of 61 or fewer antenna elements at any one time, and it will steer the antenna beam by activating or enabling different sets of the 61 or fewer antenna elements.

Because it is desirable to enable 61 antenna elements at any one given time, the antenna will need 61 signals to drive the antenna elements. Thus, power splitter 1002 is configured to divide signal 1001 into at least 61 signals 1008-1-1008-61, which in turn enter switching circuitry 1004. As one skilled in the art will appreciate, most power splitters are configured to split signals into powers-of-two signals, so in the illustrated embodiment, power splitter 1002 may be configured to split signal 1001 into 64 signals, with 61 of the signals 1008 entering switching circuitry 1004. The remaining signal 1010 may be used for other purposes, such as feed-back signal analysis and the like.

Switching circuitry 1004 comprises one input 1008 and one 1×N switch or multiplexer 1009 for each antenna element 904 that can be enabled at one time (61 is this example). Thus, in accordance with this embodiment, each switch 1009, will have N outputs, one for each cluster 902. In the embodiment illustrated in FIG. 10, to make the circuitry easier to follow, only two switches or MUXs are shown (1009-1 and 1009-61). One skilled in the art will appreciate, however, that the present invention includes one switch or MUX for each input signal 1008 (61 in this example). In addition, while the output of switches 1009 is shown as a single line in the illustrated embodiment, one skilled in the art will appreciate that there are N outputs with each output going to one of the clusters 902. This is denoted by the /N on the signal line.

For purposes of explaining one embodiment of switching circuitry 1004, assume each of the elements in the array shown in FIG. 9*a* may be labeled in the form of L,K, where L is one of the N-number of the 61 element clusters 902 within a hexagon of elements, and K is a particular element of that or any other of the N-number of clusters 902. In one embodiment, for K=1, the center element is denoted. Thus, L,1 is the center element of the Lth cluster. FIG. 9*b* illustrates one embodiment of how each of the clusters 1-N can be labeled. Thus, in FIG. 10, element 1,1 is labeled 904-1-1; element 2,1 is labeled 904-2-1; element N,1 is labeled 904-N-1; element 1,61 is labeled 904-1-61; element 2,61 is labeled 904-2-61; etc. Thus, in keeping with this example, L, 38 is the top element of the Lth cluster, and so on. One skilled in the art, however, will appreciate that any suitable numbering scheme may be used, and thus, the present invention is not limited to the illustrated embodiment.

In the illustrated embodiment, the signal splitter output signal 1008-1 is connected to any of the L,1 elements through a 1×N selector switch. Similarly, output signal 1008-2 is connected to any of the L,2 elements through a 1×N selector switch, and so on. As mentioned above, in one embodiment, the 1×N switch may be a multiplexer. In another embodiment, the 1×N switch may be realized as an ensemble of M on/off switches, where M is the total number of antenna elements in array 900 (N×61 total antenna elements in this example). Since only one switch is required for each element, only M switches are needed, not the N×M switches of the previous embodiment.

As mentioned previously, in this particular embodiment, 61 or fewer antenna elements can be enabled at one time, and the active or enabled antenna elements may coincide with one of the hexagonal array configurations 902, or the active or enabled antenna elements may overlap multiple hexagonal array configurations 902. Thus, any contiguous 61 elements can be switched-on at any one time merely by specifying the hexagonal cluster that should be used for each signal 1008, so that only one antenna element 904 for each signal 1008 is on at one time. For example, if antenna element 904-1-1 is enabeled, antenna elements 904-2-1, 904-3-1 . . . 904-61-1 cannot be enabled. Similarly, if antenna element 904-2-56 is enabled, the other antenna elements 56 in the other hexagonal array configurations cannot be enabled. In this manner, only one element associated with each signal line 1008 will be enabled at one time.

In one embodiment, the active array is constrained to be comprises of contiguous element. In other embodiments, however, the antenna elements that are enabled need not be contiguous, so different groups or rings of antenna elements can be powered on at any given time. In this embodiment, however, to have non-contiguous elements enabled at one time, there will be clusters or subsets of contiguous antenna elements fewer than 61, such that only 61 total antenna elements are enabled at one time. By enabling different non-contiguous clusters of antenna elements, signal canceling antenna elements can be eliminated, as discussed above.

The switches used in switching matrix 1004 may comprise any suitable switch type, such as MEMS switches, pin-diode switches, or the like. In one embodiment, it may be preferable to use MEMS switches to control the size of the array.

Switch control logic 1006 is configured to control the switching matrix 1004, and in particular, the individual switches in the matrix. Switch control logic 1006 may comprise any suitable control circuitry, such as a processor, an FPGA, an ASIC or the like, and it may receive switch control signals other sources, such as a master processor or the like. The details of control circuitry 1006 should be apparent to those skilled in the art, and thus, will not be discussed in detail herein.

In other embodiments of the invention, switching circuitry 1000 may comprise a signal amplifier 1014, which amplifies the input signal 1001 before it passes into splitter 1002. In addition, for antennas arrays configured for both transmit and receive, switching circuitry 1000 may include a filter/diplexer 1016 which separates the transmit signals from the receive signals. In the illustrated embodiment, the transmit signals pass into splitter 1002, while the receive signals are passed to a receiver 1018.

While the embodiment illustrated in FIGS. 9*a*, 9*b* and 10 is described herein such that the hexagonal array configurations 902 comprise 61 antenna elements, and the antenna array 900 will have 61 or less antenna elements switched on at one time, one skilled in the art will appreciate that the hexagonal array configuration and the number of active elements can be more or less than the 61 specified. For example, the hexagonal array configuration may only comprise 7, 19, or 37 elements, or the hexagonal array configuration may comprise more elements, such as 91, 127, 169, etc. Thus, the present invention is not limited to the specific embodiment illustrated in FIGS. 9*a*, 9*b* and 10, and disclosed herein.

In conclusion, the present invention provides novel antenna array configurations and associated switching systems and methods. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. An antenna array system, comprising:

a plurality of antenna elements organized in an array and configured to form a non-planar shaped antenna array surface; and switching circuitry configured to switch each of the plurality of antenna elements on or off based on control signals;

wherein the antenna beam direction is steered in a first direction by switching on a first set of antenna elements, and wherein the antenna beam direction is steered in a second direction by switching on a second set of antenna elements.

2. The antenna array system as recited in claim 1, wherein the antenna beam direction is steered in a plurality of directions by switching on a set of antenna elements for each of the plurality of directions.

3. The antenna array system as recited in claim 1, wherein the antenna elements are selected from the group consisting of cylindrical horn antenna elements, conical horn antenna elements, step-cylinder horn antenna elements, dipole antenna elements, helical antenna elements and slot antenna elements.

4. The antenna array system as recited in claim 1, wherein the antenna elements are symmetrically located within the antenna array.

5. The antenna array system as recited in claim 1, wherein the antenna elements are evenly spaced within the antenna array.

6. The antenna array system as recited in claim 1, wherein the antenna elements are the same size.

7. The antenna array system as recited in claim 1, wherein the non-planar shaped antenna array surface comprises a non-planar shape selected from the group consisting of a spherical convex shape, a spherical concave shape, a parabolic convex shape, a parabolic concave shape, an ellipsoidal convex shape, an ellipsoidal concave shape, a saddle shape, and an airfoil shape.

8. The antenna array system as recited in claim 1, wherein the antenna array is a transmit antenna array, a receive antenna array, or a transmit and receive antenna array.

9. The antenna array system as recited in claim 1, wherein the antenna array comprises M-number of antenna elements, and wherein the switching circuitry is configured to control N-number of the M-number of antenna elements at a given time, the switching circuit comprising:

a signal splitter adapted to split a signal into N-number of signals;

a switching matrix comprising N×M-number of switches; and switch control circuitry adapted to control the switching matrix so that a specified set of the N-number of the M-number of antenna elements are switched on.

10. The antenna array system as recited in claim 9, wherein the switching matrix comprises MEMS switches.

11. The antenna array system as recited in claim 9, wherein the switching circuit further comprises a signal amplifier adapted to amplify the signal prior to the signal entering the signal splitter.

12. The antenna array system as recited in claim 9, wherein the switching circuit further comprises a filter/diplexer adapted to separate transmit and receive signals to/from the antenna array.

13. The antenna array system as recited in claim 1, wherein the antenna array system is adapted for use on ground stations, air vehicles, water vehicles, ground vehicles or space vehicles.

14. The antenna array system as recited in claim 1, wherein the antenna array comprises a hexagonal array of antenna elements.

15. The antenna array system as recited in claim 14, wherein the hexagonal array comprises a plurality of hexagonal antenna element clusters abutted together to form the hexagonal array, each hexagonal antenna element cluster comprising X-number of antenna elements configured in a hexagonal arrangement.

16. The antenna array system as recited in claim 15, wherein the antenna array comprises N-number of the hexagonal antenna element clusters, and wherein the switching circuitry is configured to control X-number of antenna elements at a given time, the switching circuit comprising:

a signal splitter adapted to split a signal into X-number of signals;

a switching matrix comprising X-number of 1×N switches; and switch control circuitry adapted to control the switching matrix so that a contiguous set of the X-number of the antenna elements are enabled.

17. The antenna array system as recited in claim 16, wherein the 1×N switches comprise multiplexers.

18. The antenna array system as recited in claim 16, wherein the antenna array comprises a total of M-number of antenna elements, and wherein the 1×N switches comprise M-number of on/off switches.

19. A spacecraft, comprising:

an antenna array system, comprising:

a plurality of antenna elements organized in an array and configured to form a non-planar shaped antenna array surface; and switching circuitry configured to switch each of the plurality of antenna elements on or off based on control signals;

wherein the antenna beam direction is steered in a first direction by switching on a first set of antenna elements, and wherein the antenna beam direction is steered in a second direction by switching on a second set of antenna elements.

20. The spacecraft as recited in claim 19, wherein the antenna beam direction is steered in a plurality of directions by switching on a set of antenna elements for each of the plurality of directions.

21. The spacecraft as recited in claim 19, wherein the antenna elements are selected from the group consisting of cylindrical horn antenna elements, conical horn antenna elements, step-cylinder horn antenna elements, dipole antenna elements, helical antenna elements and slot antenna elements.

22. The spacecraft as recited in claim 19, wherein the antenna elements are symmetrically located within the antenna array.

23. The spacecraft as recited in claim 19, wherein the antenna elements are evenly spaced within the antenna array.

24. The spacecraft as recited in claim 19, wherein the antenna elements are the same size.

25. The spacecraft as recited in claim 19, wherein the non-planar shaped antenna array surface comprises a non-planar shape selected from the group consisting of a spherical convex shape, a spherical concave shape, a parabolic convex shape, a parabolic concave shape, an ellipsoidal convex shape, an ellipsoidal concave shape, a saddle shape, and an airfoil shape.

26. The spacecraft as recited in claim 19, wherein the antenna array is a transmit antenna array, a receive antenna array, or a transmit and receive antenna array.

27. The spacecraft as recited in claim 19, wherein the antenna array comprises M-number of antenna elements, and wherein the switching circuitry is configured to control N-number of the M-number of antenna elements at a given time, the switching circuit comprising:

a signal splitter adapted to split a signal into N-number of signals;

a switching matrix comprising N×M-number of switches; and switch control circuitry adapted to control the switching matrix so that a specified set of the N-number of the M-number of antenna elements are switched on.

28. The spacecraft as recited in claim 27, wherein the switching matrix comprises MEMS switches.

29. The spacecraft as recited in claim 27, wherein the switching circuit further comprises a signal amplifier.

30. The spacecraft as recited in claim 27; wherein the switching circuit further comprises a filter/diplexer adapted to separate transmit and receive signals to/from the antenna array.

31. The spacecraft as recited in claim 19, wherein the antenna array comprises a hexagonal array of antenna elements.

32. The spacecraft as recited in claim 31, wherein the hexagonal array comprises a plurality of hexagonal antenna element clusters abutted together to form the hexagonal array, each hexagonal antenna element cluster comprising X-number of antenna elements configured in a hexagonal arrangement.

33. The spacecraft as recited in claim 32, wherein the antenna array comprises N-number of the hexagonal antenna element clusters, and wherein the switching circuitry is configured to control X-number of antenna elements at a given time, the switching circuit comprising:

a signal splitter adapted to split a signal into X-number of signals;

a switching matrix comprising X-number of 1×N switches; and switch control circuitry adapted to control the switching matrix so that a contiguous set of the X-number of the antenna elements are enabled.

34. The spacecraft as recited in claim 33, wherein the 1×N switches comprise multiplexers.

35. The spacecraft as recited in claim 33, wherein the antenna array comprises a total of M-number of antenna elements, and wherein the 1×N switches comprise M-number of on/off switches.

* * * * *